US005434583A

United States Patent [19]

Hesse et al.

[11] Patent Number: 5,434,583

[45] Date of Patent: Jul. 18, 1995

[54] COMMUNICATION WITH REENTRY VEHICLE THROUGH MODULATED PLASMA

[75] Inventors: Philip W. Hesse, Ellicott City; Han S. Uhm; Joon Choe, both of Potomac, all of Md.

[73] Assignee: The United States of America as represented by the Secretary of the Navy, Washington, D.C.

[21] Appl. No.: 247,827

[22] Filed: May 23, 1994

[51] Int. Cl.[6] ..... H01Q 1/28

[52] U.S. Cl. ..... 343/705; 343/708

[58] Field of Search ..... 343/708, 705, 872

[56] References Cited

U.S. PATENT DOCUMENTS

| | | | |
|---|---|---|---|
| 2,583,540 | 1/1952 | Bennett | 343/705 |
| 3,566,235 | 2/1971 | Rose | 343/705 X |
| 3,568,202 | 3/1971 | Filton | 343/709 |
| 3,846,798 | 11/1974 | Cal | 343/705 |
| 4,509,709 | 4/1985 | Uttan et al. | 343/705 X |
| 4,922,259 | 5/1990 | Hall et al. | 343/700 MS |
| 5,315,309 | 5/1994 | Rudow et al. | 343/708 X |

*Primary Examiner*—Donald Hajec
*Assistant Examiner*—Tho G. Phan
*Attorney, Agent, or Firm*—Jacob Shuster

[57] ABSTRACT

Signal antennae are mounted on the casing wall between forward nose and rear tail ends of an aerospace launched vehicle for radio communication through a radiation conducting sheath of plasma formed thereon by atmospheric ionization during descent of the vehicle along a non-gliding reentry path. The reentry path is maintained by vehicle guidance at a steep angle in response to data transmitted to the antennae through the radiation conducting sheath having a plasma content minimized by cooling which is thereby maintained in complete surrounding relation to the vehicle and modulated to enhance data transmission during the entire duration of vehicle descent.

8 Claims, 2 Drawing Sheets

COMMUNICATION WITH REENTRY VEHICLE THROUGH MODULATED PLASMA

This invention relates generally to radio frequency communication with aerospace launched vehicles during reentry descent toward earth.

BACKGROUND OF THE INVENTION

During return travel to earth, ionization of molecules occurs in the upper atmosphere adjacent to an aerospace launched reentry vehicle. The electrons and ions of oxygen and nitrogen so produced form a plasma of increasing charge density. At some point during vehicle descent, the charge density of the plasma reaches a level at which a conducting sheath is formed on the casing wall of the vehicle to reflect rf signals therefrom. Heretofore, such conducting plasma sheath caused a communication 6 blackout at distances between 100,000 and 20,000 feet above the earth's surface. Accordingly, the conducting plasma sheath is regarded by persons skilled in the art as a blackout shield detrimental to aerospace vehicle flight missions.

In an attempt to solve the communication problem involving the aforementioned conducting plasma sheath at different frequencies and power levels, travel guidance control over the reentry vehicle throughout its descent was provided by signals from a plurality of stationary satellites to maintain reentry travel along a shallow glide angle path. The conducting plasma sheath formed on the reentry vehicle as a blackout shield was thereby limited to a bottom portion thereof so that communication with one of the stationary satellites could be maintained through an antenna mounted on a vertical surface portion of the reentry vehicle at its tail end.

It is therefore an important object of the present invention to provide communication with a reentry vehicle throughout its descent without restriction or confinement of the conducting plasma sheath formed thereon, and without thereby directionally limiting communication to one source of guidance control data, as heretofore proposed in order to solve the communication blackout problem.

It is a further and related object of the invention to enable radio frequency communication with a reentry vehicle directly through the conducting plasma sheath formed thereon during descent as a result of atmospheric ionization adjacent to the casing wall of the vehicle.

SUMMARY OF THE INVENTION

In accordance with the present invention, the conducting plasma sheath formed by atmospheric ionization about a reentry vehicle during descent is modulated so as to enable transmission of radio frequency signals directly therethrough along the entire reentry path of the vehicle. Such modulation is effected by electromagnetic energy produced by a driving voltage applied to communication antennae mounted on or in close adjacency to the surface of the vehicle casing wall between its nose and tail ends. The reentry vehicle is thereby guided by signals, received during descent along a steep, non-gliding path, to assure that the modulated radiation conducting sheath is formed from plasma in complete surrounding relation to the casing wall of the reentry vehicle. According to certain embodiments of the invention, the casing wall of the vehicle may be cooled at its nose end during descent to minimize spacing of the modulated radiation conducting sheath therefrom and thereby reducing its plasma content to enhance rf signal transmission therethrough.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENTS

Figure 1:
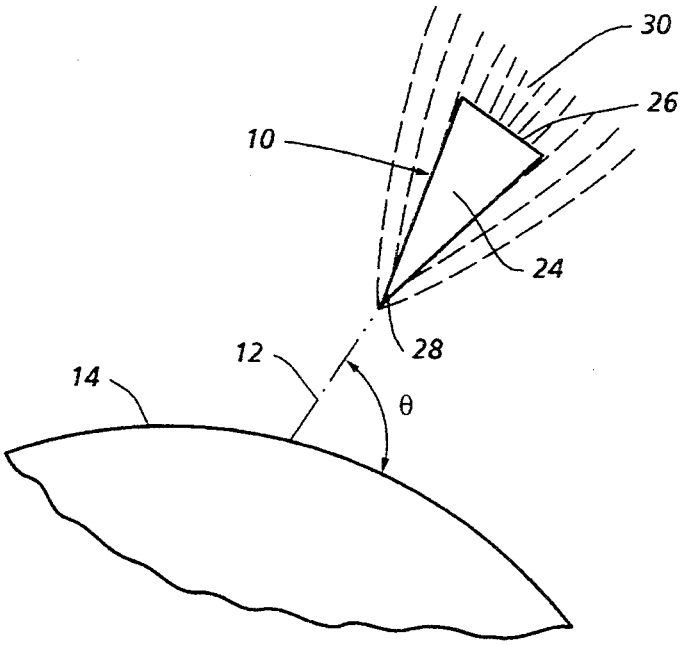
FIG. 1 is a simplified partial side view of an aerospace launched reentry vehicle during descent toward the earth through its upper atmosphere.

Referring now to the drawing in detail, FIG. 1 illustrates a reentry vehicle, generally referred to by reference numeral 10, undergoing guided travel through the upper atmosphere along a descent path 12 toward the surface of earth 14 at relatively steep reentry angle Θ. The vehicle 10 is guided along such descent path 12 by a guidance and steering control system 16, generally known in the art, as diagrammed in FIG. 2. Signal inputs are supplied to system 16 from a radio frequency receiving unit 18 to which vehicle mounted antennae 20 are connected for radio frequency communication with stationary aerospace satellites, for example, as a source of descent guidance signals.

Figure 2:
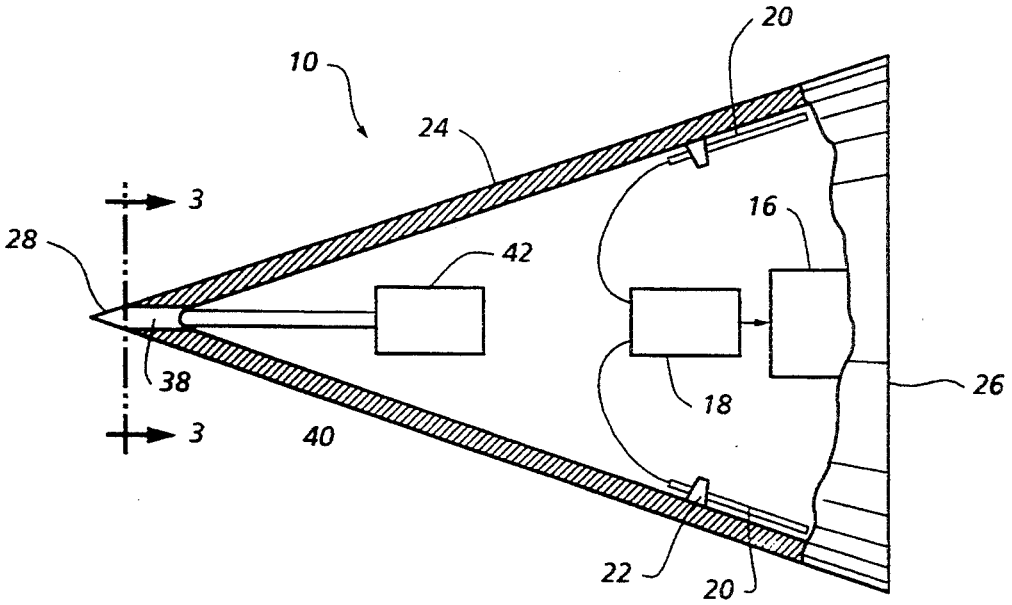
FIG. 2 is a partial side section view through the reentry vehicle shown in FIG. 1.

In accordance with the present invention, the antennae 20 are positioned by mounting fixtures 22 just below the outer conical surface of casing wall 24 of the vehicle 10, between its rear tail end 26 and forward nose end 28. Thus, the elongated elements of the antennae 20, as shown in FIG. 2, extend rearwardly from fixtures 22 in close spaced adjacency to the inner surface of the casing wall 24. By virtue of such antennae arrangement, the signal receiving unit 18 is operative through system 16 to establish a non-gliding, steep descent path 12 at the reentry angle Θ for purposes of the present invention as hereinafter explained.

With continued reference to FIG. 1, the vehicle 10 during approach to the earth 14 through the upper atmosphere causes ionization of nitrogen and oxygen molecules in the air to form a trailing plasma 30. The charge density of the plasma so produced increases during vehicle descent to a point where an electrically conducting sheath of the plasma is formed about the casing wall 24 of the vehicle 10. Because of the steep angle Θ of descent as aforementioned, all outer surfaces of the vehicle casing wall are completely surrounded by the conducting sheath.

Figure 4:
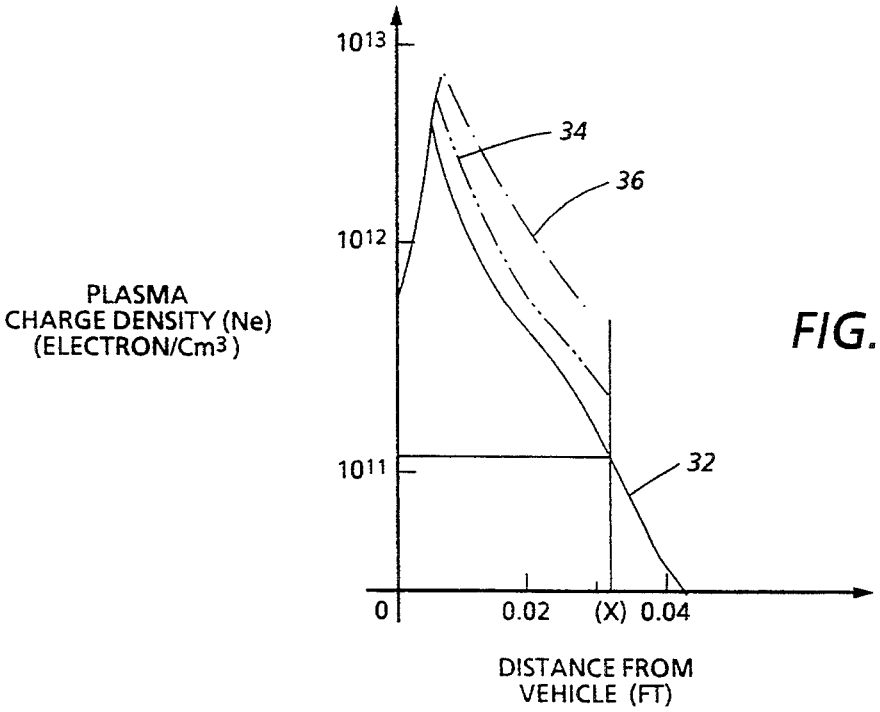
FIG. 4 is a comparative graph of plasma sheath characteristics.

It was found that the conducting plasma sheath when appropriately modulated by electromagnetic energy cooperates with the antennae 20 to receive and transmit radio frequency signals directly therethrough for appropriate exercise of communications including transmission of guidance control data. Such modulation is effected in response to driving voltage applied to antennae 20 from unit 18 so that electromagnetic forces so generated radiate rf signals. Utilization of such signal radiating action of the plasma sheath for the entire duration of guidance controlled vehicle descent is made possible, in accordance with the present invention, because of the prolonged duration of the existence of the conducting plasma sheath during descent of the reentry vehicle. FIG. 4 graphically compares the conducting plasma sheath in terms of increasing charge density as reflected by graphically plotted line 32, with plasma sheaths heretofore established on descending reentry vehicles along shallow glide angle paths, as reflected by plotted lines 34 and 36. As indicated in the graph of FIG. 4, heretofore the conducting plasma sheaths of increasing charge density reflected by plots 34 and 36 did not exist beyond a certain distance X (between 0.03 and 0.04 feet) from the vehicle casing wall as compared to the plasma sheath corresponding to plot 32, having a conducting sheath of plasma closer to the casing wall. It is therefore contemplated that establishment of a more effective modulated plasma sheath for the entire descent duration will be assured by minimizing plasma spacing from the vehicle wall.

Figure 3:
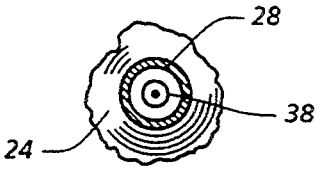
FIG. 3 is a partial section view taken substantially through a plane indicated by section line 3—3 in FIG. 2.

In accordance with certain embodiments of the invention the plasma content of the conducting sheath may be reduced by cooling of the vehicle adjacent to its nose end portion 28 during descent. Thus, as shown in FIGS. 2 and 3 a gas jet passage conduit 38 is formed at the nose end 28 of the casing wall. The passage 38 is connected by tubing 40 to a gas generator 42 within the vehicle in order to effect cooling of the vehicle wall by discharge of a jet of gas through passage 38 during vehicle descent. The amount of plasma in the conducting sheath is thereby minimized while maintaining its shape in surrounding relation to the vehicle wall 24 in order to maximize the RF radiation transmission property produced by plasma modulation.

Figure 5:
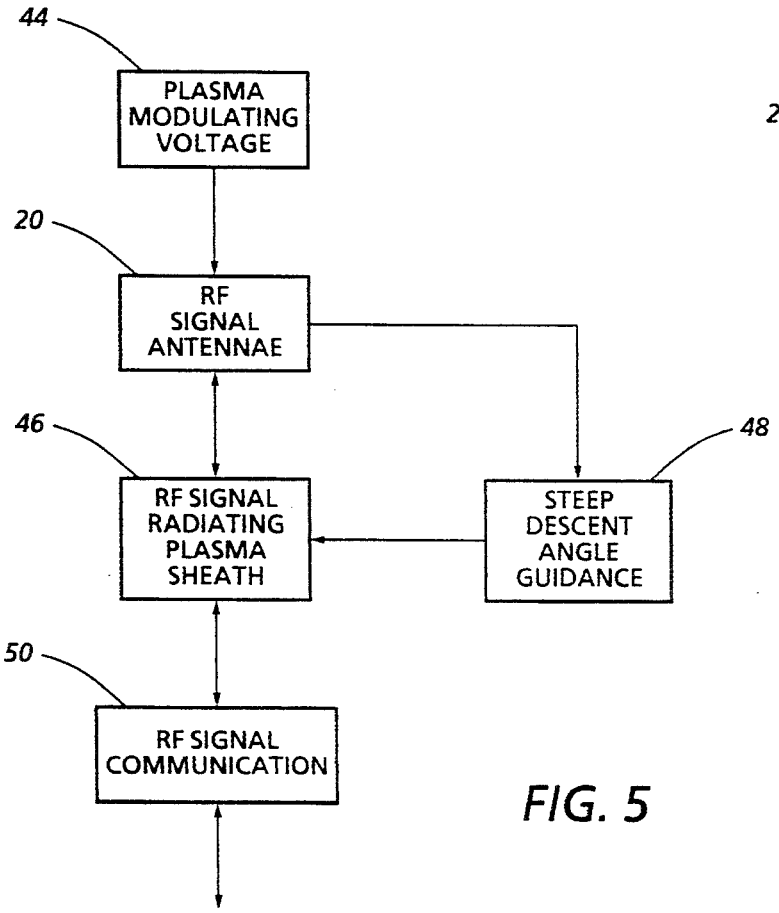
FIG. 5 is a block diagram summarizing the method associated with the present invention.

The method associated with the present invention as hereinbefore described is summarized by reference to the block diagram of FIG. 5, wherein the RF signal antennae 20 are depicted as receiving a plasma modulating voltage 44 from unit 18 for application to the plasma sheath 46. Establishment of the plasma sheath 46 in complete surrounding relation to the casing wall 24 is assured by guidance of the vehicle 10 along its path 12 at the steep descent angle Θ, as denoted in FIG. 5 by block 48. Such guidance occurs in response to RF signal input received by the antennae 20 through the conducting plasma sheath 46 during RF signal communication established therethrough for the duration of vehicle descent, as also depicted in FIG. 5 by block 50.

Obviously, other modifications and variations of the present invention may be possible in light of the foregoing teachings. It is therefore to be understood that within the scope of the appended claims the invention may be practiced otherwise than as specifically described.

What is claimed is:

1. In combination with an aerospace launched vehicle undergoing travel toward earth to produce a sheath of plasma of increasing charge density by ionization of atmosphere surrounding the vehicle between nose and tail ends thereof, said vehicle having a casing wall enclosing control means for guiding said travel along a descent path at a reentry angle to the earth and antenna means operatively connected to the control means for supply of guidance data thereto in response to receipt of radiation signals, the improvement residing in: mounting means positioning the antenna means in close adjacency to the casing wall for receiving the radiation signals through the sheath on the casing wall during said travel of the vehicle and means cooling the nose end of the vehicle for minimizing spacing of the plasma in the sheath from the casing wall.

2. The improvement as defined in claim 1 wherein and said cooling means includes a gas generator and conduit means connected to the gas generator and extending through the nose end of the vehicle for discharge of a jet of cooling gas therefrom.

3. The combination of claim 2 wherein said reentry angle of the descent path is relatively steep to assure establishment of the sheath in complete surrounding relation to the casing wall during said travel of the vehicle.

4. The combination of claim 1 wherein said reentry angle of the descent path is relatively steep to assure establishment of the sheath in complete surrounding relation to the casing wall during said travel of the vehicle.

5. In combination with an aerospace launched vehicle undergoing descent toward earth to produce plasma of increasing charge density by ionization of surrounding atmosphere, said vehicle having a nose end and a casing wall extending therefrom on which antenna means is mounted for reception of radiation signals, a method for enhancing communication with the vehicle through said antenna means, including the steps of: applying electromagnetic energy through the antenna means to the plasma for modulation thereof into a radiation conducting sheath extending from said nose end about the casing wall; transmitting the radiation signals directly through the modulated plasma of the radiation conducting sheath for said reception thereof by the antenna means to guide said descent of the vehicle and cooling the vehicle during said descent thereof for minimizing content of the plasma in the radiation conducting sheath extending from the nose end of the vehicle.

6. The method as defined in claim 5 wherein the descent of the vehicle is guided along a relatively steep reentry angle path establishing the radiation conducting sheath in complete surrounding relation to the casing wall during said descent of the vehicle.

7. The method as defined in claim 6 wherein said step of cooling the vehicle comprises discharge of a jet of coolant from the nose end of the vehicle to minimize spacing of the radiation conducting sheath from the casing wall.

8. The method as defined in claim 5 wherein said step of cooling the vehicle comprises discharge of a jet of coolant from the nose end of the vehicle to minimize spacing of the radiation conducting sheath from the casing wall.

* * * * *